United States Patent [19]

Wesson et al.

[11] Patent Number: 4,976,645

[45] Date of Patent: Dec. 11, 1990

[54] BUBBLE FORMING AND BATH SOAP DISPENSING DEVICE

[76] Inventors: Caren L. Wesson, 8965 N. Fielding Rd., Bayside, Wis. 53217; Colleen J. Mandell, 2652 Falmouth Rd., Toledo, Ohio 43615

[21] Appl. No.: 436,376

[22] Filed: Nov. 14, 1989

[51] Int. Cl.[5] ..... A63H 33/28; C11D 17/04

[52] U.S. Cl. ..... 446/15; 446/71; 252/92; 252/134

[58] Field of Search ..... 446/15, 19, 20, 71; 252/174, 134, 92; D28/8.1; D6/532; D21/61

[56] References Cited

U.S. PATENT DOCUMENTS

| | | | |
|---|---|---|---|
| D. 59,416 | 10/1921 | Finger . | |
| 657,791 | 9/1900 | Schindler | 446/19 |
| 1,284,440 | 11/1918 | Pierce | 446/19 |
| 1,526,052 | 2/1925 | Christian | 446/20 |
| 2,382,949 | 8/1945 | McLaren . | |
| 2,514,009 | 7/1950 | Raspet | 446/15 |
| 2,720,723 | 10/1955 | Peretti . | |
| 3,968,262 | 7/1976 | Hodska | 446/15 X |
| 4,770,649 | 9/1988 | Cuccio | 446/15 |
| 4,808,138 | 2/1989 | von Braunhut | 446/16 |

*Primary Examiner*—Mickey Yu

*Attorney, Agent, or Firm*—Marshall & Melhorn

[57] ABSTRACT

A device for forming bubbles and dispensing soap includes an elongated shaft having a handle attached to one end and a supporting ring attached to an opposite end thereof. The ring is encapsulated in soap material which also is ring-shaped and has a central aperture formed therein adapted for forming bubbles. The handle can be U-shaped and oriented for suspending from a bar of a soap dish or towel rack. Alternatively, the handle can be any one of various other shapes including cartoon figures, animals and the like. The device can be utilized to apply soap to a wash cloth or directly to the bather's skin and soap bubbles can be formed by passing air through the aperture.

15 Claims, 1 Drawing Sheet

BUBBLE FORMING AND BATH SOAP DISPENSING DEVICE

BACKGROUND OF THE INVENTION

The present invention relates generally to bath toys and, in particular, to a combination bubble forming toy and bath soap dispensing apparatus.

Bubble blowing devices are well known in the prior art and have generally been used as toys for amusement. Typically, the bubble blowing device includes a ring-shaped or loop-shaped apertured end attached to a handle. The apertured end is dipped into a soap solution in a container to accumulate a film of dissolved soap. Then bubbles are blown by passing air through the aperture covered with the soap film.

It is well known that bath soap can be utilized to form bubbles. During a child's bath for example, a portion of the bath soap is dissolved in the bath water and bubbles are formed as the water is agitated by washing and/or play actions.

SUMMARY OF THE INVENTION

The present invention concerns a device which combines a bubble making toy with bath soap. Thus, the device can be utilized to form bubbles, as a source of soap during a bath, and as a combination of both functions to amuse a child during his or her bath.

The device includes a longitudinally extending shaft having a handle formed at one end thereof and a supporting ring formed at an opposite end thereof. Bath soap is molded about the supporting ring leaving a relatively small central aperture. When the ring end of the device is dipped in water, a soapy film will be formed which coats the outer surface of the soap and also extends across the central aperture. As air is forced through the central aperture, such as by blowing through the aperture or moving the device through the air, the soapy film covering the aperture is formed into bubbles.

Of course, the soap end of the device can be utilized for applying soap to a wash cloth or directly to the bather's skin. The handle end of the shaft can be formed in a U-shape to aid in holding the device and also to reduce the risk of injury to a child utilizing the device. Alternatively, the handle end can be formed in any other suitable shape such as a clown head, a cartoon character, an animal, etc.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
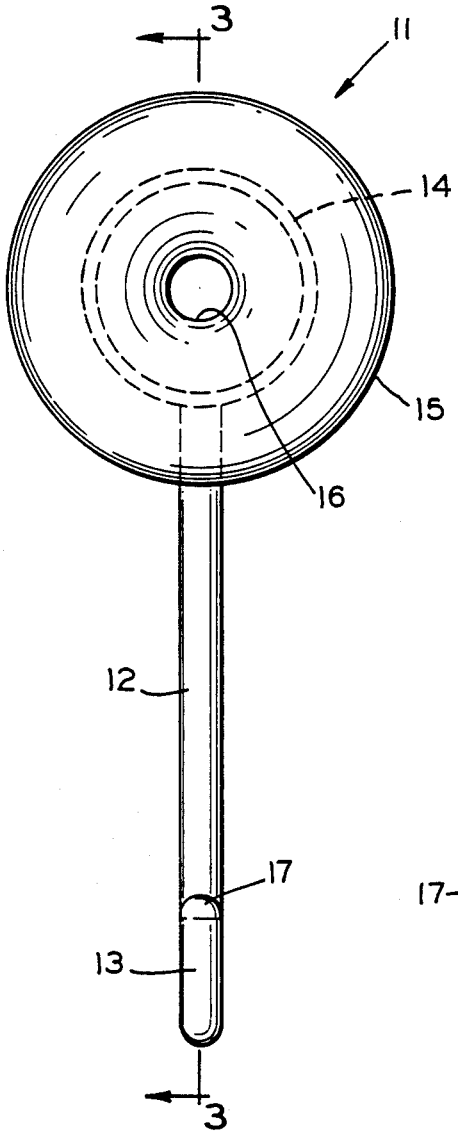
FIG. 1 is a front elevational view of a bubble forming and bath soap dispensing device in accordance with the present invention.
Figure 2:
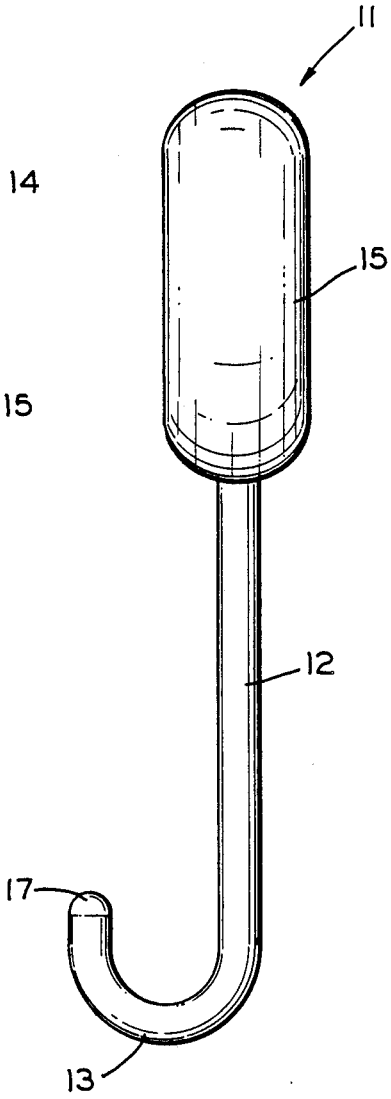
FIG. 2 is a side elevational view of the device shown in FIG. 1.
Figure 3:
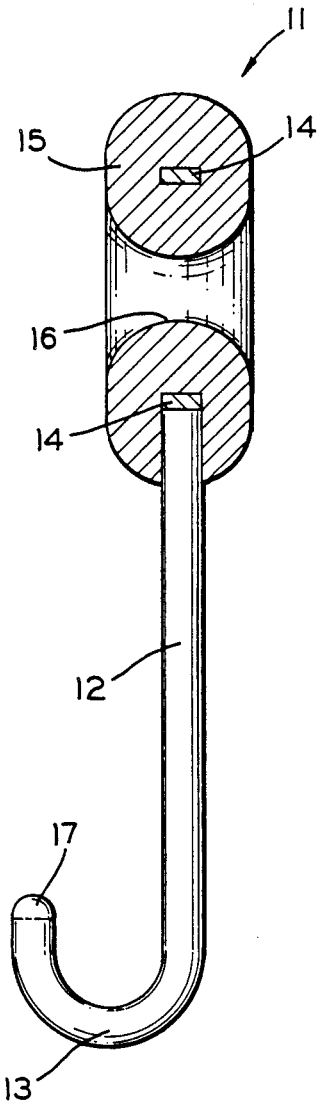
FIG. 3 is a cross sectional view of the device taken along the line 3—3 in FIG. 1.

In the FIGS. 1 through 3, there is shown a device 11 which combines bath soap with a bubble making apparatus. The device 11 includes a longitudinally extending shaft 12 having a handle 13 formed at a lower or one end thereof. At the upper or opposite end of the shaft 12, there is formed a soap retaining ring 14. A soap material 15 completely encapsulates the ring 14 and the adjacent end of the shaft 12. The soap material 15 is also formed as a ring having a central aperture 16.

Although the shaft 12 has been shown as having a generally circular cross section, it can be formed in any suitable shape. Similarly, the ring 14 has been illustrated as having a generally rectangular cross section, but other cross-sectional shapes can be substituted therefor.

An outer surface of the ring 14 is attached to the upper end of the shaft 12. Thus, an axis of the ring 14 extends in a generally perpendicular direction with respect to a longitudinal axis of the shaft 12. Typically, the soap material 15 is molded concentric with the ring 14 as is the central aperture 16.

Figure 4:
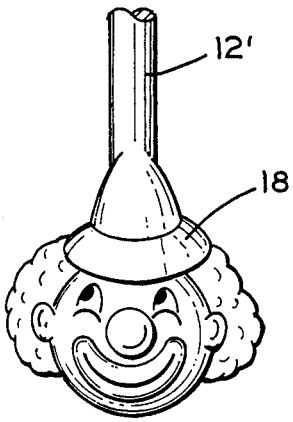
FIG. 4 is a fragmentary front elevational view of an alternate embodiment of the device shown in FIG. 1.

A free end 17 of the handle 13 is rounded to reduce the possibility of injury to the user of the device 11. The handle 13 is shaped and sized to accommodate the smaller hand sizes of children to enable them to grip the device securely when applying soap or using the device to form bubbles. Also, the hook lies in a plane which is generally orthogonal to a plane in which the ring 14 lies. Thus, the shape of the hook and its orientation with respect to the ring 14 allows the device 11 to be conveniently suspended from the bar of a soap tray or towel rack. Many alternate forms of handles can be utilized such as a clown head 18 which is shown in FIG. 4 attached to a lower end of a shaft 12'. The clown head 18 is representative of many different shapes such as cartoon characters, animals, and the like.

In operation, the device 11 is grasped by the handle 13 and the upper end, including the soap material 15, is dipped into water. The water dissolves some of the soap material causing a soapy film to be formed which covers the outer surface of the soap material 15 and forms a film across the central aperture 16. When air is forced through the central aperture 16, by blowing through the aperture or moving the device through the air, the soapy film covering the aperture is forced into a bubble shape which separates from the device 11. In addition, the device 11 can be utilized to apply the soap material 15 to a wash cloth, for example, or directly to the bather's skin. The handle 13 and the elongated shaft 12 permit even a small child to apply the soap to hard to reach areas such as the child's back.

Typically, the shaft 12, the handle 13 and the ring 14 can be formed of any suitable material such as a plastic. The soap material 15 can be any commercially available substance, but preferably one which easily forms bubbles when dissolved in water and does not dissolve too quickly. In one embodiment, the shaft 12 and the handle 13 can be approximately six inches long and the ring can be approximately one quarter inch thick. The outer diameter of the soap material 15 can be about three and one half inches with an approximately one half inch diameter central aperture 16. Of course, as the device is utilized, the diameter of the central aperture 16 will increase and the outer diameter of the soap material 15 will decrease.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A bubble forming and soap dispensing device comprising:

an elongated shaft having upper and lower ends;

a handle means attached to said lower end of said shaft, said handle means being generally U-shaped; and a supporting ring attached to said upper end of said shaft and adapted to be encapsulated by a molded soap material having an aperture formed therein, said handle means lying in a plane generally orthogonal to a plane in which said ring lies.

2. The device according to claim 1 wherein said elongated shaft has a generally circular cross section.

3. The device according to claim 1 wherein said handle means has a rounded free end.

4. The device according to claim 1 wherein said supporting ring has a generally rectangular cross section.

5. The device according to claim 1 wherein an outer surface of said supporting ring is attached to said upper end of said shaft and an axis of said supporting ring extends generally perpendicular to a longitudinal axis of said shaft.

6. The device according to claim 1 including soap material encapsulating said supporting ring and having a bubble forming aperture therein.

7. A bubble forming and soap dispensing device comprising:

an elongated shaft;

a generally U-shaped handle means attached to one end of said shaft;

a supporting ring having an outer surface attached to an opposite end of said shaft, an axis of said supporting ring extending generally perpendicular to a longitudinal axis of said shaft; and molded soap material encapsulating said supporting ring, said soap material having an aperture formed therein adapted to form bubbles.

8. The device according to claim 7 wherein said handle means lies in a plane generally orthogonal to a plane in which said supporting ring lies.

9. A bubble forming and soap dispensing device comprising:

an elongated shaft;

a handle means attached to one end of said shaft and adapted to fit a hand of a child;

a supporting ring having an outer surface attached to an opposite end of said shaft, an axis of said supporting ring extending generally perpendicular to a longitudinal axis of said shaft; and molded bath soap material encapsulating said supporting ring, said soap material being ring-shaped and having an aperture formed therein adapted to form bubbles, said shaft having a length sufficient for a child grasping said handle means to apply said soap material to his own back.

10. The device according to claim 9 wherein said elongated shaft has a generally circular cross section.

11. The device according to claim 9 wherein said handle means has a rounded free end.

12. The device according to claim 9 wherein said handle means is generally U-shaped.

13. The device according to claim 9 wherein said handle means lies in a plane generally orthogonal to a plane in which said supporting ring lies.

14. The device according to claim 9 wherein said handle means is formed in the shape of a clown head.

15. The device according to claim 9 wherein said supporting ring has a generally rectangular cross section.

* * * * *